United States Patent [19]

Shaklee

[11] 4,315,455

[45] Feb. 16, 1982

[54] ADJUSTABLE SOFFIT VENT

[76] Inventor: James L. Shaklee, Rte. 6, Box 11, Enid, Okla. 73701

[21] Appl. No.: 122,445

[22] Filed: Feb. 19, 1980

[51] Int. Cl.[3] ..... F24F 13/00

[52] U.S. Cl. ..... 98/32; 98/42 R; 98/DIG. 6; 98/42 A

[58] Field of Search ..... 98/DIG. 6, 32, 42 A, 98/42 R; 49/71; 229/7 R

[56] References Cited

U.S. PATENT DOCUMENTS

| | | | |
|---|---|---|---|
| 1,803,851 | 5/1931 | Horwath | 229/7 R |
| 1,850,514 | 3/1932 | Norwood | 49/71 |
| 1,966,284 | 7/1934 | Brucker | 229/7 R |
| 2,200,031 | 5/1940 | Lee | 98/42 R |
| 2,755,728 | 7/1956 | Frisby | 98/DIG. 6 |
| 3,073,235 | 1/1963 | Smith et al. | 98/42 R |
| 3,125,942 | 3/1964 | Smith | 98/DIG. 6 |
| 3,232,205 | 2/1966 | Bumstead | 98/32 |

*Primary Examiner*—Henry C. Yuen

*Attorney, Agent, or Firm*—Laney, Dougherty, Hessin & Beavers

[57] ABSTRACT

A roof venting apparatus for installation under roof eaves to provide adjustable ventilation. The device consists of a frame that is attachable under the roof eaves while also providing a central air flow space upward therethrough, a foraminous covering over the central air flow space to prevent insect entry to the protected space, and an air scoop panel which is coactively inserted through the frame means and operative to be positioned in either open or closed position relative to the frame.

7 Claims, 2 Drawing Figures

ADJUSTABLE SOFFIT VENT

BACKGROUND OF THE INVENTION

1. Field of the Invention

The invention relates generally to building soffit vents and, more particularly, but not by way of limitation, it relates to an improved form of adjustable soffit vent which is more economically manufactured and more easily used in operation.

2. Description of the Prior Art

A prior are search discloses numerous types of soffit vents that have been used in varying forms for quite a long time. Very few adjustable vents were discovered but of those vents that did provide some form of adjustment, the overall structure and mode of construction was entirely different from the present invention. A patent to Frisby, U.S. Pat. No. 2,718,187, discloses an adjustable form of ventilator for use in house eaves, but the device includes an inordinate amount of spring-/lever structure for operation, while also requiring an actuating tool to effect seasonal opening and/or closing of the vents to the external elements. U.S. Pat. No. 3,232,205 in the name of Bumstead discloses yet another ventilator for positioning in soffit, and this device includes still another form of adjustable closure, i.e. a snap cover 42. This device includes no air scoop advantages since the snap cover 42 is entirely removable during the summer months.

SUMMARY OF THE INVENTION

The present invention relates to improvements in construction of adjustable soffit ventilators as are generally employed beneath the eaves of building roof structure. The device consists of two or three-part assembly which can be entirely constructed utilizing stamping and bending equipment to provide a foraminous air filter panel in coactive association with an adjustable cover panel that also provides an air scoop function in its open position. The cover panel is formed so that it can be coactively assembled with the air filter panel merely by forming bends, and the cover panel may be selectively positioned in any of several degrees of open to incoming air flow.

Therefore, it is an object of the present invention to provide an adjustable air vent that is more simplified in construction and less expensive in cost.

It is also an object of the present invention to provide an improved soffit air vent which may be readily closed off during cold weather months.

Finally, it is an object of the invention to provide a simplified coactive structure which may be readily installed within roof soffit structure to provide adjustable ventilation.

Other objects and advantages of the invention will be evident from the following detailed description when read in conjunction with the accompanying drawings which illustrate the invention.

DETAILED DESCRIPTION OF THE INVENTION

Figure 1:
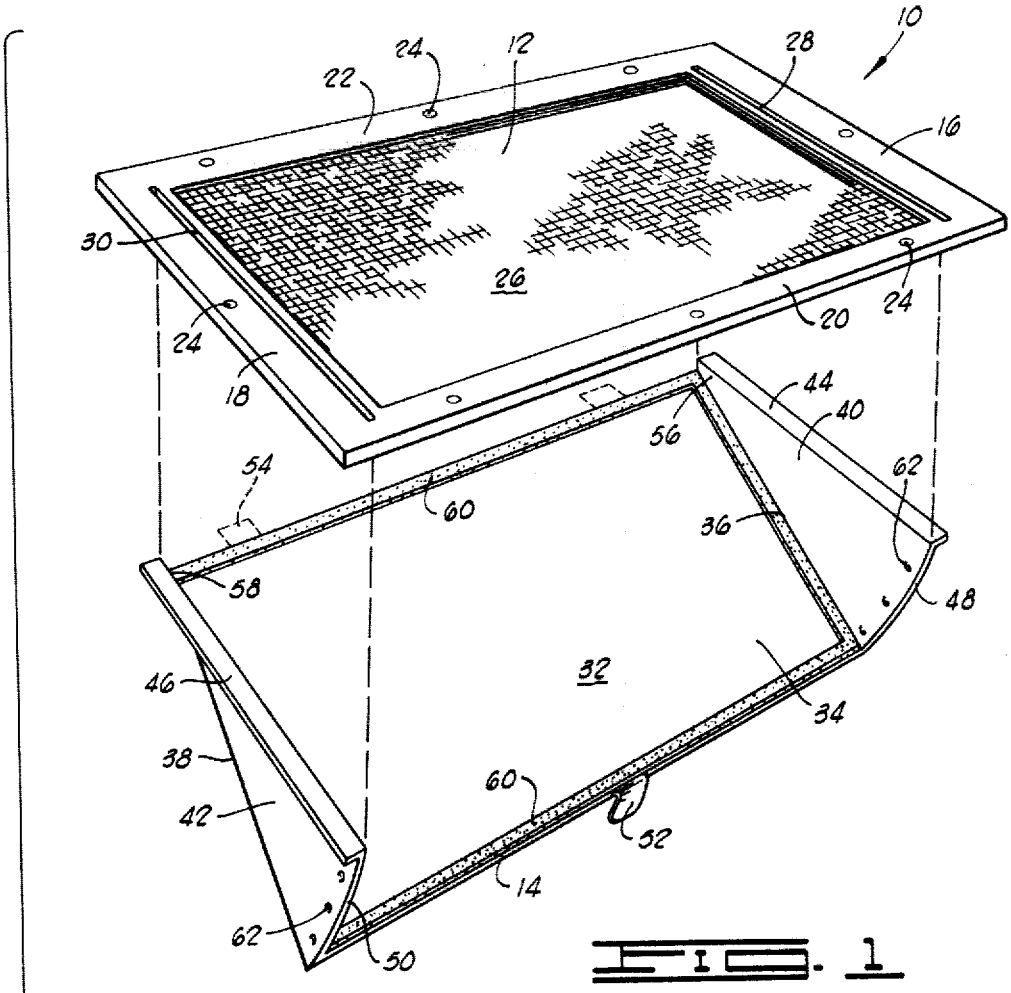
FIG. 1 is an exploded perspective view of a soffit vent as constructed in accordance with the present invention.

FIG. 1 illustrates a soffit vent 10 consisting of a frame element 12 and an adjustable cover element 14. The frame element 12, as may be rectangularly formed, consists of a rigid panel frame having opposed frame edges 16 and 18 joined by opposed frame edges 20 and 22, frame element 12 including a plurality of mounting or fastening holes 24 as spaced therearound. A central air flow space is provided by a perforated or foraminous area 26 coextensive between inner edges of respective frame sides 16, 18, 20 and 22.

It is preferred that foraminous portion 26 be unitarily formed from the same stock as the sides of frame 12 by perforation through punching or stamping of the flat metal stock. This may be achieved variously by punching or slitting the area in a prescribed pattern to enable the desired degree of open area that permits ready air flow while also preventing entry of insects and the like. A pair of scoop receiving slots 28 and 30 are formed in parallel along the respective frame sides 16 and 18.

An air scoop closure panel 32 is formed for coactive assembly with the vent frame 12. The closure panel 32 may also be unitarily formed through conventional cutting and bending operations for final disposition in adjustable affixure to the vent frame 12. Thus, the closure panel 32 is formed with a base panel 34 and perpendicular bends at opposite ends 36 and 38 extending into sectoral end panels 40 and 42. In assembly, the sectoral end panels 40 and 42 are inserted upward within respective guide slots 28 and 30 of vent frame 12 whereupon additional right angle bends are made to form retaining strips 44 and 46. The closure panel 32 is then captively retained for adjustable positioning beneath vent frame 12. The outer ends 48 and 50 of end panels 40 and 42 are arcuately formed at a radial length equal to slot length, i.e. guide slots 28 and 30, to enable the proper closure race through all positions of cover panel 32. A pull tab or 90° bent tab 52 may be also unitarily formed during the cutting and bending operations.

If desired, a selected plurality of hinges 54 may be provided for spot welding affixure beneath rear frame side 22; however, these are not necessarily required since the inner radial ends 56 and 58 of sectoral side panels 40 and 42, respectively, in association with bent strips 44 and 46, will retain the rear edge of cover panel 32 in tight, hinged relationship adjacent the underside of vent frame 12. A suitable form of weather stripping 60 or other suitable resilient insulator may be secured around the perimeter of panel 34 to provide air-tight sealing beneath bent frame 12 when in the closed position. Also, a plurality of selectively spaced dimples 62 may be formed arcuately across sectoral end panels 40 and 42 so that interference fit within respective frame slots 28 and 30 will enable secure positioning and retention of the cover panel 32 at a selected open or closed position.

Figure 2:
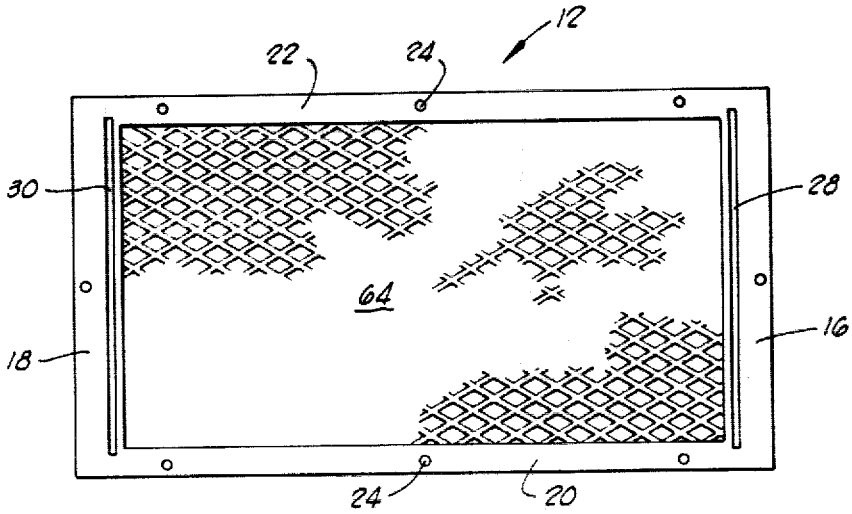
FIG. 2 is a plan view of an alternative form of foraminous frame structure as utilized in the present invention.

FIG. 2 illustrates an alternative form of vent frame 12 that is formed by utilizing expanded metal practices in forming the foraminous center portion. Thus, vent frame 12 is formed with the side frames 16, 18, 20 and 22 having plural selectively spaced securing holes 24 and guide slots 28 and 30. However, the center portion 64 is formed by stamping and rolling into a selected expanded metal formation having the desired degree of open area relative to air passage therethrough. While it is preferred that the center foraminous portion of vent frame 12 be unitarily formed from the vent frame stock, for obvious matters of expense and manufacturing handling time, the center venting portion or foraminous portions 26 (FIG. 1) and 64 (FIG. 2) may be a separate screen panel inserted and secured as by bonding or the like about the inner perimeter of side frames 16, 18, 20 and 22.

In operation, the adjustable soffit vent 10 is disposed over a suitable cut-out portion of the soffit facing beneath the eaves of a roof, and secured by screws or the like through the securing holes 24. Clearance being ample above the soffit structure, the closure panel 32 may be manipulated by the pull tab 52 and positioned either in the upward closed position during cold weather, or selectively positioned at a lower position during warm weather. The plurality of dimples 62 enable a selected position even in the downward extremity whereby windward eave structure may be adjusted to receive desired amounts of air flow relative to leeward structures. The closure panel 32 in effect provides an air scoop relative to the inward air flow space through foraminous portion 26.

The foregoing discloses a novel form of adjustable vent for providing interior roof space ventilation, the device may be readily mounted in operative position and easily manually controlled to effect seasonal variation of the various ventilation apertures. While the vent device has all desirable attributes of strength, adjustability and ease of control, it is essentially a two piece construction of relatively simple principle that may be economically and reliably constructed.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A roof vent for installation under roof eaves to provide adjustment of ventilation, comprising:

frame means defining a central air flow space of generally rectangular form;

foraminous means formed in said central air flow space;

first and second slots formed through said frame means on opposite sides of said central air flow space; and air scoop means formed as a panel having opposite sides formed perpendicularly for interlocking reception up through said first and second slots so that said air scoop means may be positioned in selected positions to regulate the degree of opening to said central air flow space.

2. A roof vent as set forth in claim 1 wherein said foraminous means comprises:

screen means of selected percentage opening secured over said central air flow space.

3. A roof vent as set forth in claim 1 wherein said foraminous means comprises:

a continuous metal panel with said frame means that is perforated in selected pattern to define said central air flow space.

4. A roof vent as set forth in claim 3 that is further characterized in that:

said continuous metal panel is expanded by a selected pattern of percentage open.

5. A roof vent as set forth in claim 1 wherein:

said perpendicular opposite sides of said air scoop means are each formed as a sector having radius equal to the length of said respective first and second slots.

6. A roof vent as set forth in claim 5 which is further characterized in that:

a respective radial side of each perpendicular opposite side is bent to perpendicular to provide a retaining stop within the respective first and second slots.

7. A roof vent as set forth in claim 5 which is further characterized to include:

at least one selectively positioned dimple formed in each of said perpendicular opposite sides of said air scoop means to provide stop means relative to said first and second slots thereby to secure selected positioning of said air scoop means panel.

* * * * *